US006266854B1

(12) United States Patent
Ancona et al.

(10) Patent No.: US 6,266,854 B1
(45) Date of Patent: Jul. 31, 2001

(54) CLOTHESPIN OR MULTIPURPOSE CLAMP

(75) Inventors: Bruce E. Ancona; Louis F. Henry, both of New York, NY (US)

(73) Assignee: Ekco Housewares, Inc., Franklin Park, IL (US)

( * ) Notice: Subject to any disclaimer, the term of this patent is extended or adjusted under 35 U.S.C. 154(b) by 0 days.

(21) Appl. No.: 09/302,256

(22) Filed: Apr. 30, 1999

(51) Int. Cl.[7] ..... D06F 55/02
(52) U.S. Cl. ..... 24/499
(58) Field of Search ..... 24/499, 30.5 R; D32/61, 62; 294/99.2; 606/158, 208; 223/85.91, 93, 96, DIG. 2; D8/395; 248/316.5, 316.7

(56) References Cited

U.S. PATENT DOCUMENTS

| | | | | |
|---|---|---|---|---|
| D. 354,134 | * | 1/1995 | Tanaka . | |
| D. 393,117 | | 3/1998 | Doyle et al. | D32/61 |
| 350,291 | | 10/1886 | Chadwick | 24/570 |
| 867,031 | | 9/1907 | Glading | 24/362 |
| 1,274,344 | | 7/1918 | Staub | 24/561 |
| 1,868,726 | | 7/1932 | Collier . | |
| 2,542,077 | | 2/1951 | Gershen | 24/562 |
| 2,898,922 | * | 8/1959 | Lyman . | |
| 2,988,314 | * | 6/1961 | Urich . | |
| 3,302,648 | * | 2/1967 | Nelson . | |
| 3,921,640 | * | 11/1975 | Freeborn . | |
| 4,760,624 | | 8/1988 | Fish | 24/30.5 |
| 5,159,731 | | 11/1992 | Dereadt | 24/552 |
| 5,179,768 | * | 1/1993 | Jio . | |

* cited by examiner

*Primary Examiner*—James R. Brittain
(74) *Attorney, Agent, or Firm*—Ross, Ross & Flavin

(57) ABSTRACT

A unitary clothespin or multipurpose clamp molded from a resilient plastic material having a hair-pin like configuration comprising a loop for permitting suspension, the loop terminating in a pair of confronting gripping jaws, the jaws being releasably, and pivotally interconnected and being movable between a closed, gripping position in contact with each other and an open, nongripping position not in contact with each other upon the application or. release of a squeezing compressive force upon the loop.

1 Claim, 3 Drawing Sheets

CLOTHESPIN OR MULTIPURPOSE CLAMP

BACKGROUND OF THE INVENTION

1. Field of the Invention

The invention relates to molded plastic articles such as clothespins for suspending laundry from such as a clothesline, or multipurpose clamps such as bag clips, hobby clamps or ice tongs.

2. Description of Related Art

Wooden clothespins of the unitary simple split type and of the double jaw, spring-loaded type are well known.

However, the wood in both types is subject to rot and deterioration and the springs of the springloaded type are subject to rust and easy breakage, twist and disassemble and pinch the user.

Molded plastic clothespins and clamps are also available.

However, most are expensive or complicated in their construction and unreliable in their use and, when used as clothespins, allow the articles which they are intended to hold suspended from such as a clothesline to fall to the ground or floor.

BRIEF SUMMARY OF THE INVENTION

It is an object of the invention to provide a simple, inexpensive reliable, unitary, clothespin or multipurpose clamp which may be molded as an integral unit fabricated from a resilient plastic.

Another object is to provide such a clothespin or multipurpose clamp having a hairpin like configuration to include a loop allowing its suspension from a line or the like and a pair of pivotally related jaws which may be moved between a gripping,confronting position wherein the jaws are in contact with one another and an open position wherein the jaws are separated by the application or release of a squeezing pressure on the loop.

DETAILED DESCRIPTION OF THE INVENTION

A clothespin, or multipurpose clamp embodying the invention, generally indicated by the numeral 10, is fabricated from a resilient plastic material such as high impact polystyrene or the like.

Figure 13:
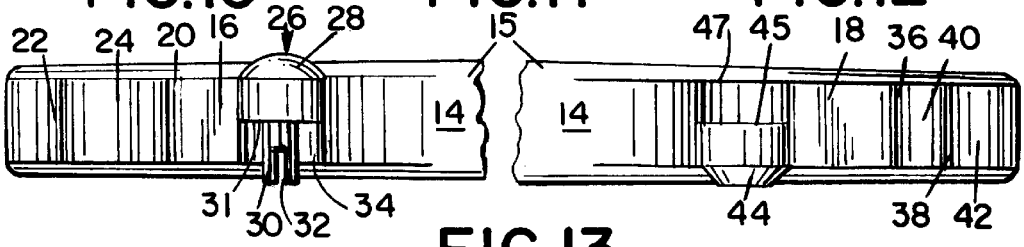
FIG. 13 is a broken top plan view of the Clothespin or multipurpose clamp of the invention laid flat to illustrate its inner planar face.

As shown in FIG. 13, clothespin or multipurpose clamp 10 is molded to provide an elongated, substantially rectangular integral unit having a substantially flat, outer face 12 and an inner face 14 which has a flat, central main body portion 15, a first raised portion 16 extending inwardly from one of its free ends and communicating with one end of main body portion 15, and a second raised portion 18 extending inwardly from its opposite free end and communicating with the opposite end of main body portion 15.

First raised portion 16 includes, adjacent its outer end, a pair of spaced, parallel rounded projections 20 and 22 which extend across inner face 14 and are separated by a rounded depression 24.

First raised portion 16 also includes, adjacent its inner end and one end of main body portion 15, a combination locking/pivot member 26 having an annular crowned head 28 which extends across approximately one-half the width of inner face 14 and has an integral locking/pivot pin 30 disposed centrally thereof.

Locking/pivot pin 30 extends from a flat inner face 31 of crowned head 28 across inner face 14 of the clothespin and is split for a portion of its length as at 32 for purposes to appear.

A semi-circular depression 34 is provided in raised portion 16 immediately below locking/pivot pin 30, also for purposes to appear.

Second raised portion 18 includes adjacent its outer end, a series of spaced, parallel, alternating rounded projections 36 and 38 and rounded depressions 40 and 42 which extend across inner face 14.

Second raised portion also includes, adjacent its inner end, and the opposite end of main body portion 14, an annular hub 44 which extends across approximately one-half the width of inner face 14.

Hub 44 has a flat inner face 45 and is provided with a central through bore 46 of a diameter complemental to the outer diameter of locking/pivot pin 30 on locking/pivot member 26 of first raised portion 16.

A semi-circular depression 47 is provided in raised portion 18 immediately adjacent hub 44, also for purposes to appear.

In use, the opposite free ends of the clothespin or multipurpose clamp are grasped and raised portions 16 and 18 thereof are brought into a confronting, face-to-face relation, with main body portion 15 now having a curved configuration to form a loop 17 wherein the clothespin or multipurpose clamp assumes a hair-pin like or inverted U-shape as shown in FIGS. 1–4, and FIGS. 14 and 15.

At this time, the clothespin or multipurpose clamp now may be suspended from a clothesline C, or the like, with inner face 14 of main body portion 15 and loop 17 resting on the clothesline.

Figure 1:
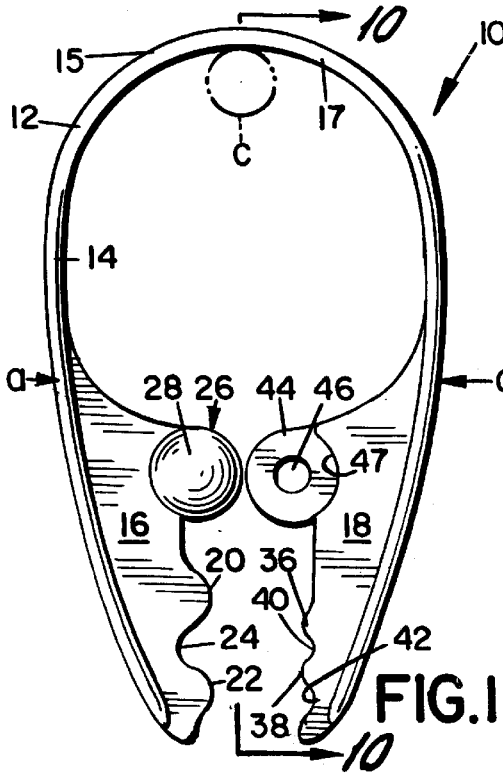
FIG. 1 is a top plan view of the Clothespin or multipurpose clamp of the invention in an opened, or non-use position.
Figure 2:
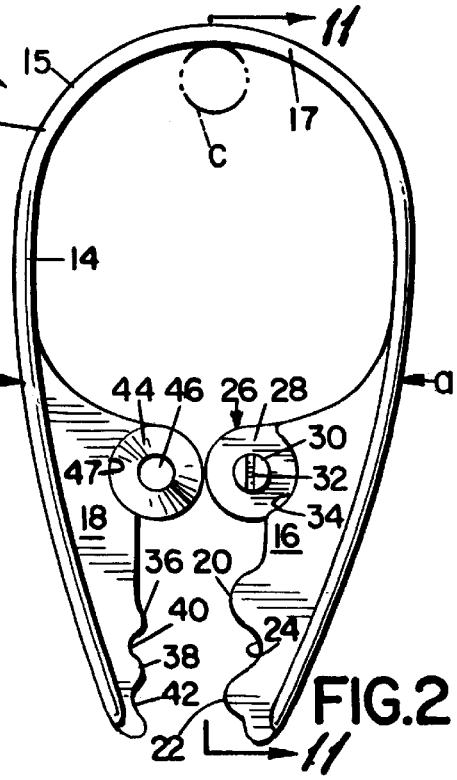
FIG. 2 is a bottom plan view of the Clothespin or multipurpose clamp of FIG. 1.

Raised portions 16 and 18 now may be inter-engaged, by being moved from the positions of FIGS. 1 and 2 to the positions of FIGS. 3, 4, 14 and 15.

Body portions 16 and 18 are interengaged by deflecting raised portion 18 to a position behind raised portion 16, exerting an inward pressure on outer face 12 in the direction of the arrows a so as to bring locking/pivot pin 30 of locking/pivot member 26 into alignment with through bore 46 of hub 44 and pressing with the fingers on the outer surfaces of crowned head 28 of raised portion 16 and hub 44 of raised portion 18 to snap locking/pivot pin 26 into through bore 46, with split 32 in pin 26 permitting compression of the pin for easy passage through the bore.

Body portions 16 and 18 may be separated by simply reversing the above noted procedure.

Figure 3:
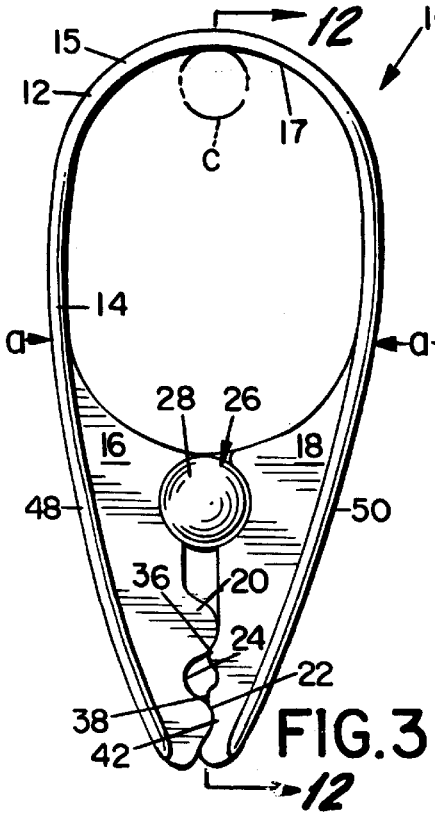
FIG. 3 is a top plan view of the Clothespin or multipurpose clamp of the invention in a closed, or use position.
Figure 4:
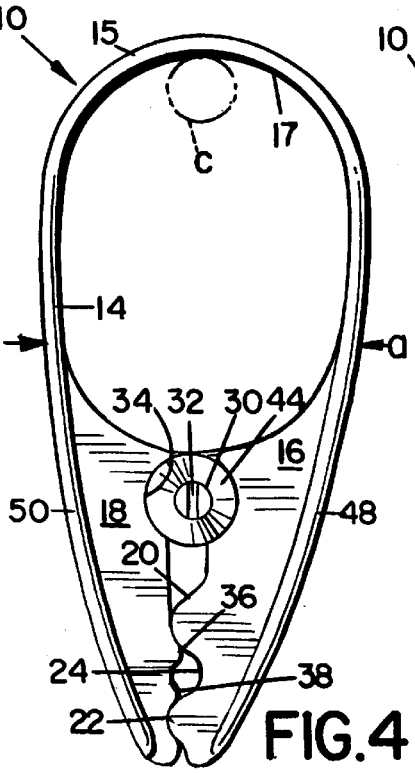
FIG. 4 abottom plan view of the Clothespin or multipurpose clamp of FIG. 3.
Figure 5:
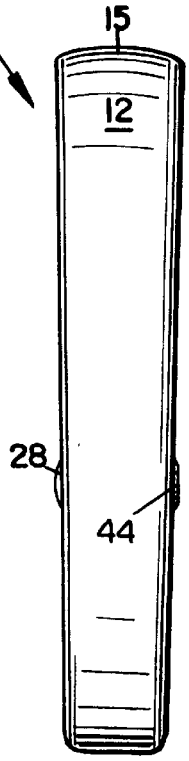
FIG. 5 aside elevational view of the Clothespin or multipurpose clamp of FIG. 1, the opposite side being a mirror image.
Figure 6:
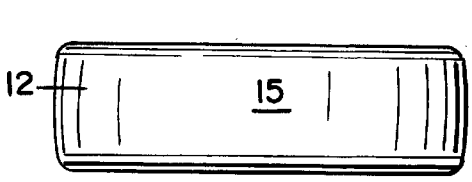
FIG. 6 is an end elevational view as seen from the top of FIG. 1.
Figure 7:
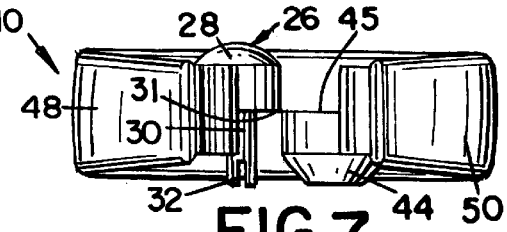
FIG. 7 is an end elevational view as seen from the bottom of FIG. 1.
Figure 8:
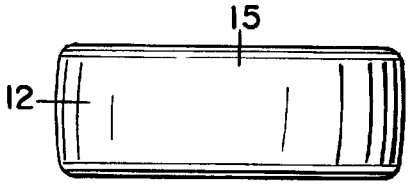
FIG. 8 is an end elevational view as seen from the top of FIG. 3.
Figure 9:
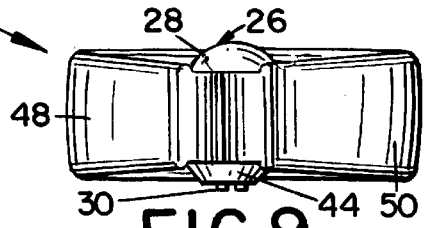
FIG. 9 is an end elevational view as seen from the bottom of FIG. 3.
Figure 10:
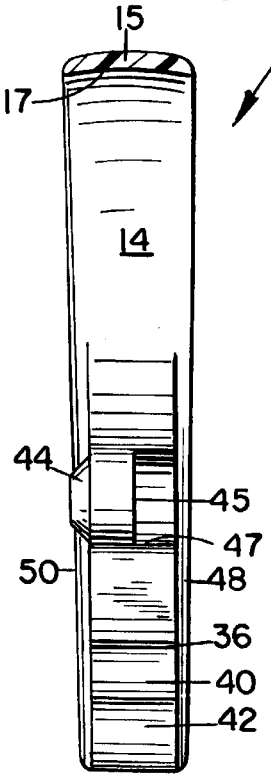
FIG. 10 is a cross sectional view taken on line 10—10 of FIG. 1.
Figure 11:
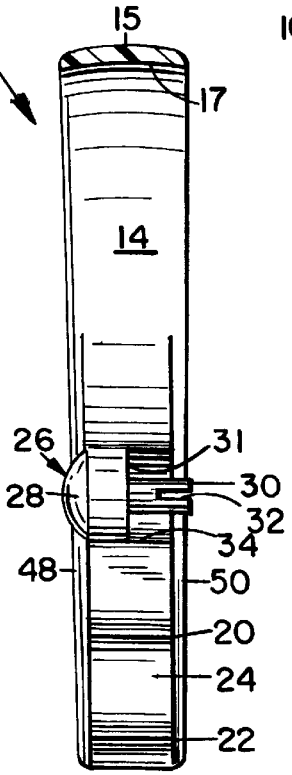
FIG. 11 is a cross sectional view taken on line 11—11 of FIG. 2.
Figure 12:
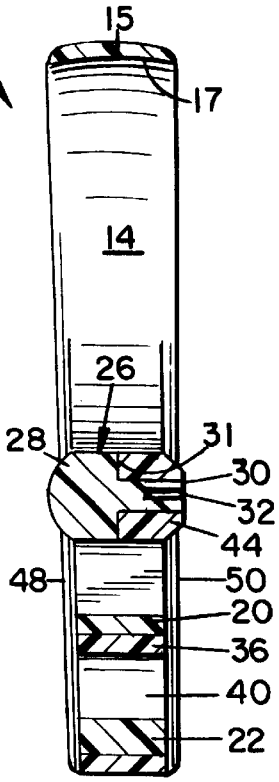
FIG. 12 is a cross sectional view taken on line 12—12 of FIG. 3.

In the closed configuration of FIGS. 3 and 4, hub 44 is disposed in semi-circular depression 34 of raised portion 16, annular crowned head 28 is disposed in semi-circular depression 47 of raised portion 18, and the flat inner faces 31 and 45 of crowned head 28 and hub 44 respectively are resting against each other as shown in FIG. 12, with raised portions 16 and 18 now forming confronting faces of a pair of pivotally interrelated jaws 48 and 50 for firmly gripping miscellaneous items.

In the closed configuration of FIGS. 3 and 4, rounded projections 20 and 22 of raised portion 16 of jaw 48 are pressing firmly against the inner face of raised portion 18 of jaw 50 with rounded projection 20 being disposed immediately above rounded projection 36 of portion 18, and with rounded projection 22 pressing into rounded depression 42 of raised portion 18.

Figure 15:
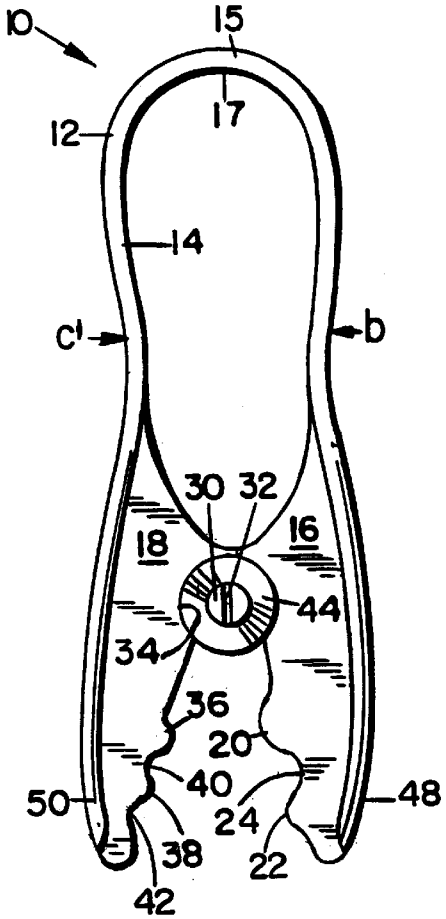
FIG. 15 is a bottom plan view of the Clothespin or multipurpose clamp of FIG. 14.
Figure 14:
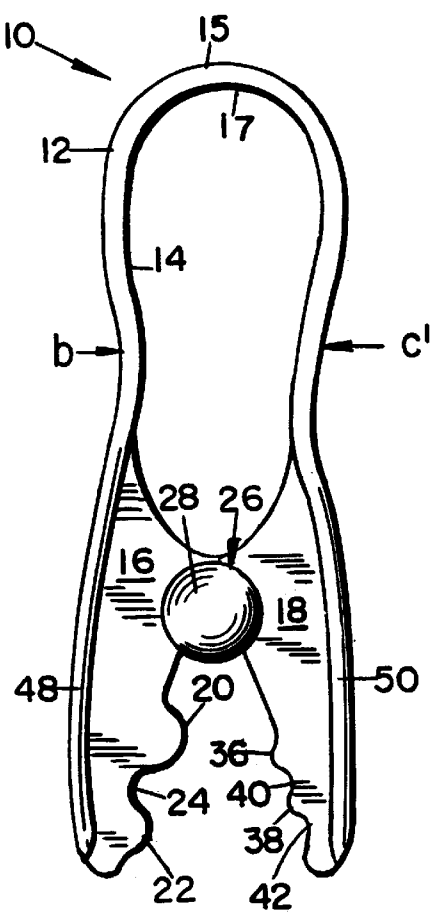
FIG. 14 is a top plan view of the Clothespin or multipurpose clamp of the invention in a closed, or use position, with the lower jaws spread apart and ready to accept clothes to be hung.

With the clothespin or multipurpose clamp in the closed position of FIGS. 3 and 4, the lower ends of jaws 48 and 50 may be opened or spread apart as shown in FIGS. 14 and 15 by applying a squeezing pressure to outer face 12 at pressure points b and c immediately above raised portions 16 and 18 respectively of the jaws to deflect loop 17 inwardly causing the lower ends of the jaws to move outwardly as the raised portions 16 and 18 pivot relative to each other relative to locking/pivot pin 30.

When such squeezing pressure is released, the jaws return automatically to their closed, confronting positions.

We claim:

1. A unitary clothespin or multipurpose clamp molded from a resilient plastic material having a hair-pin like configuration comprising a loop, the loop terminating in a pair of confronting gripping jaws, and means permitting releasable, pivotal interconnection of the jaws whereby the jaws may be moved between a position whereby the jaws are not pivotally interconnected, thereby permitting suspension of the loop from a line or other support, and a position whereby the jaws are pivotally interconnected thereby precluding removal of the loop from the line or other support, and whereby when the jaws are pivotally interconnected, the jaws may be moved between a closed, gripping position in contact with each other for securely holding an article therebetween and an open, non-gripping position not in contact with each other for release of the article held therebetween upon the application or release of a squeezing compressive force upon the loop, wherein the means for releasably pivotally interconnecting the jaws is a locking/pivot member comprising a locking/pivot pin on one jaw and an apertured hub on the other jaw, the pin being slidably receivable in and removable from the aperture of the hub in the manner of a press fit, and wherein the pin is split for a portion of its length.

* * * * *